US012228001B2

(12) United States Patent
Cheng et al.

(10) Patent No.: US 12,228,001 B2
(45) Date of Patent: Feb. 18, 2025

(54) MECHANICAL CONNECTOR WITH INTERFACE HAVING STEPPED TAPERS

(71) Applicant: Baker Hughes Oilfield Operations LLC, Houston, TX (US)

(72) Inventors: Samuel H Cheng, Katy, TX (US); Greg Dunn, Houston, TX (US); Daryl Attaway, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 14 days.

(21) Appl. No.: 16/584,406

(22) Filed: Sep. 26, 2019

(65) Prior Publication Data

US 2021/0095535 A1 Apr. 1, 2021

(51) Int. Cl.
*E21B 23/01* (2006.01)
*E21B 33/04* (2006.01)

(52) U.S. Cl.
CPC ..... *E21B 23/01* (2013.01); *E21B 33/04* (2013.01)

(58) Field of Classification Search
CPC ..... E21B 33/04; E21B 23/01
See application file for complete search history.

(56) References Cited

U.S. PATENT DOCUMENTS 4,641,708 A * 2/1987 Wightman ..... E21B 33/043 166/208
4,665,979 A 5/1987 Boehm, Jr.
5,607,019 A 3/1997 Kent
8,636,072 B2 1/2014 Gette
8,978,772 B2 3/2015 Yates
8,997,883 B2 4/2015 Gette
9,797,214 B2 10/2017 Gadre
10,113,383 B2 10/2018 Duong
2010/0126736 A1* 5/2010 Ellis ..... E21B 33/04 166/387
2013/0299193 A1 11/2013 Duong
2017/0122059 A1 5/2017 Cookston
2018/0171733 A1 6/2018 Nguyen

OTHER PUBLICATIONS

"Drilling & Production Systems Surface Wellhead & Tree Technology Update," 2009, 33 pages.
International Search Report and Written Opinion mailed Feb. 9, 2021 in corresponding PCT Application No. PCT/US20/52699.

* cited by examiner

*Primary Examiner* — Dany E Akakpo
(74) *Attorney, Agent, or Firm* — Baker Hughes Patent Organization

(57) ABSTRACT

A system for rigid locking of components in a wellhead assembly is also disclosed. The system includes a wellhead housing, a hanger, a lockdown ring, and an actuating member. The lockdown ring has a first lockdown ring surface with lockdown ring stepped tapers. The actuating member has a first actuating member surface with actuating member stepped tapers that correspond to the lockdown ring stepped tapers. The lockdown ring stepped tapers and the actuator ring stepped tapers are configured to mate when positioned between the wellhead housing and the hanger.

20 Claims, 8 Drawing Sheets

MECHANICAL CONNECTOR WITH INTERFACE HAVING STEPPED TAPERS

BACKGROUND

1. Field of Invention

This invention relates in general to equipment used in mandrels, and in particular, to a system for a mechanical connection between a hanger and a mandrel, such as a wellhead housing.

2. Description of the Prior Art

Wellhead housings, hangers, and such related drilling components are used in offshore (subsea and surface) and onshore oil and gas rigs for various purposes. In an example, the casing hanger forms part of the wellhead and is lowered into the wellbore to an appropriate depth and rested on a shoulder inside the wellhead. Separately, a piston having a cam ring is used to engage grooves in a riser assembly for gripping wellhead housings. In each of these cases, mechanical connections between one or more cylindrical bodies are required to advance a strong physical coupling via groove profiles, for instance, of these various related drilling components. However, the cylindrical bodies are provided in different sizes where fixed inner diameters are limited in existing couplers. Moreover, connectors or couplers are sometimes subject to failure for being unable to handle the loads across varying requirements.

SUMMARY

A system for locking components in a wellhead assembly is disclosed. The system includes a first wellhead component having at least one recess in an outer surface, a second wellhead component positioned adjacent the first wellhead component, and a first annular member positioned adjacent the first wellhead component. The first annular member has at least one protrusion configured to correspond to the at least one recess of the first wellhead component and has a first annular member stepped surface. The system includes a second annular member positioned adjacent the first wellhead component. The second annular member has a second annular member stepped surface adapted to interact with the first annular member stepped surface. The interaction is to limit relative movement between the first annular member and the second annular member upon contact between the first annular member stepped surface and the second annular member stepped surface.

Further, a system for rigid locking of components in a wellhead assembly is also disclosed. The system includes a wellhead housing, a hanger, a lockdown ring, and an actuating member. The lockdown ring has a first lockdown ring surface with lockdown ring stepped tapers. The actuating member has a first actuating member surface with actuating member stepped tapers that correspond to the lockdown ring stepped tapers. The lockdown ring stepped tapers and the actuator ring stepped tapers are configured to mate when positioned between the wellhead housing and the hanger.

A method for rigidly locking two components in a wellhead assembly is also disclosed. The method includes placing a first mechanical connector in an area between rigid members of the wellhead assembly. The first mechanical connector has a first mechanical connector surface with mechanical connector stepped tapers. The method includes inserting an actuating member having a first actuator member surface with actuator member stepped tapers into the area. A mating step in the method is for mating the mechanical connector stepped tapers with the actuator member stepped tapers so that the mechanical connector and the actuating member are rigidly locked together.

BRIEF DESCRIPTION OF THE DRAWINGS

Various embodiments in accordance with the present disclosure are described with reference to the drawings, in which.

DETAILED DESCRIPTION

Figure 1:
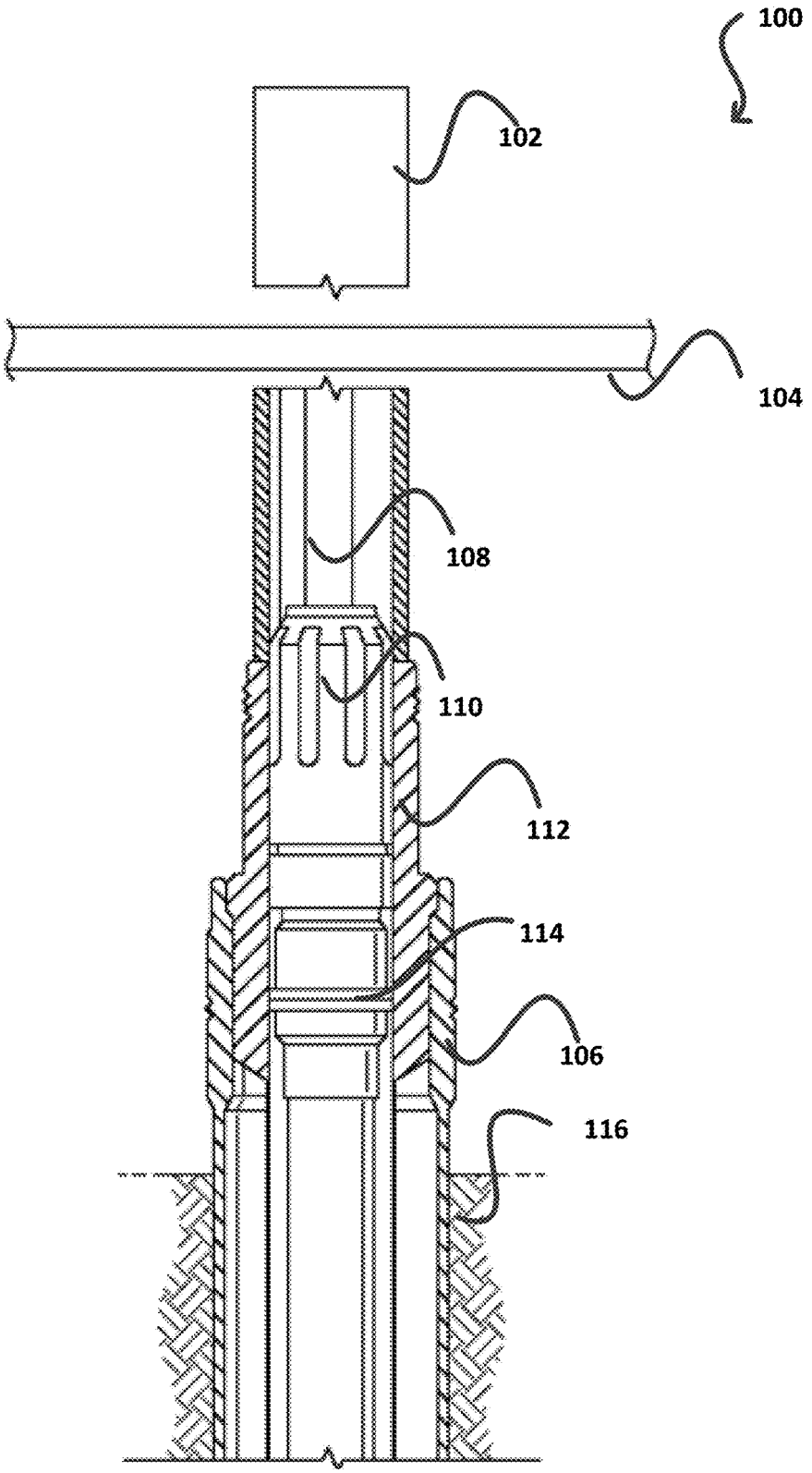
FIG. 1 illustrates an example of wellbore with casing hanger applied in a housing in which aspects of the present disclosure may be applied.

In the following description, various embodiments will be described. For purposes of explanation, specific configurations and details are set forth in order to provide a thorough understanding of the embodiments. However, it will also be apparent to one skilled in the art that the embodiments may be practiced without the specific details. Furthermore, well-known features may be omitted or simplified in order not to obscure the embodiment being described.

Rigid locking of certain components in a sealing system can help to provide control of the components when used together. For casing hangers in a wellhead, rigid locking of components can be useful to prevent forces from thermal expansion and pressure acting on the casing hanger to cause movement of the components upwards inside the wellhead. For example, in one embodiment of the present technology, certain components may be rigidly locked together so there is no gap between the components. Such an arrangement may be beneficial because a gap may permit a shuttling effect when the seal is under pressure, which can lead to failure of other components in the sealing system. When an interface, between rigidly locked components is too tight, one or more of the components may disengage from the other. In an example, if the interface between two components consists of two flat, smooth surfaces abutting at a tapered angle, the forces acting on the components can cause a wedge action. In other words, longitudinal forces acting on the interface through the tapered plane can have a transverse component. The transverse component of the force may act to disengage the components, and to unlock the components. Further, the transverse and longitudinal forces can cause the sealing system to shuttle, wear, and potentially fail. The upshot is that when interfacing surfaces between components are flat, tolerances and setting position may not permit a consistent setting force to rigidly lock the components. Either a gap can remain between the components where the rigid locking is intended, which prevents preload and permits shuttling, or the gap must be closed using a press-fit, which can be undesirable for other reasons.

Systems and methods in accordance with various embodiments of the present disclosure may overcome one or more of the aforementioned and other deficiencies by reshaping interface surfaces between components. In particular, a mechanical connector for transitions between mechanical locking applications is disclosed. The mechanical connector includes a first surface with stepped tapers for a mechanically loaded connection to a mating surface on an adjacent component. The mechanical connector can further include second surface having an engagement portion for supporting the mechanically loaded connection. In an example, the stepped tapers can form a ratcheting surface with an actuating member that may be part of a system with the mechanical connector for providing a pedestal or locked surface over which sealing or other components may be fixed. For example, components, systems, and methods of the present disclosure allow for preloaded mechanical connections (e.g. between an actuator ring and a lockdown ring) that are able to tolerate movements from forces in transitions between mechanical locking systems using stepped tapers.

A further intent of the present disclosure is to create the aforementioned pedestal or supporting structure over which components, including sealing systems may be placed, so that the pedestal offered by the combination of the mechanical connector and its mating surface prevents relative movement of the sealing system. This enables the sealing system or any associated components to be accurately placed, and enables the sealing system or any associated components to stay in position. Furthermore, adjustability in setting depth of the mechanical connector can be achieved using the stepped tapers for the mechanical connector and of the mating surface, while limiting any upward back-driving forces on the mating surface.

Various other functions can be implemented within the various embodiments as well, as discussed and suggested elsewhere herein.

FIG. 1 illustrates an example of wellbore system 100 with a casing hanger applied in a mandrel (e.g., wellhead housing, Christmas tree, or blow-out preventer), in which aspects of the present disclosure may be applied. However, a person of ordinary skill reading the present disclosure will be able to recognize variations of the present disclosure for other mechanical locking applications than wellbore applications. In present example of the wellbore system 100, region 116 may represent a subsea or offshore formation. A low pressure wellbore housing 106 may include a wellhead 112, and tubing or casing hanger 114, which may be moved into place with a running tool 110. External wellhead support structure of the low pressure wellbore housing 106 (e.g., conductor casing) supports the wellhead 112 and additional casings within the wellhead. Pipe string is fed into the wellbore to approach the required depth for placement and drilling. For example running string or landing string 108 may be used to place the hanger 114 in its position in the wellhead 112. In addition, a platform 104 may be provided, where equipment in module 102 is provided for power, communication, and monitoring between the wellhead 112 and external structures. A person of ordinary skill would recognize, from the present disclosure, the requirements to enable a stable and rigid locking of the movable portions in the tubing hanger, and a corresponding mating inner diameter of a corresponding mating surface.

A person of ordinary skill reading the present disclosure would recognize that the equipment shown in FIG. 1 may further include a power unit for providing power through the pipe string 108 into the wellbore, but also for controlling the drilling into the wellbore. The power unit may be located near the pipe string 108, at about the center of the platform 104. In addition, the wellbore system 100 may include a communications outpost for providing communications to other units, such as a subsea electronics module (SEM). Furthermore, in subsea implementations, the platform 104 can be located at the surface of the sea, while the wellhead 112 and the SEM can be located in some embodiments subsea. The power unit may be coupled with the communications to allow for redundancy and singular cable transmission through the wellhead while providing sufficient room for drilling via rotation of the appropriate pipe string 108.

Figure 2A:
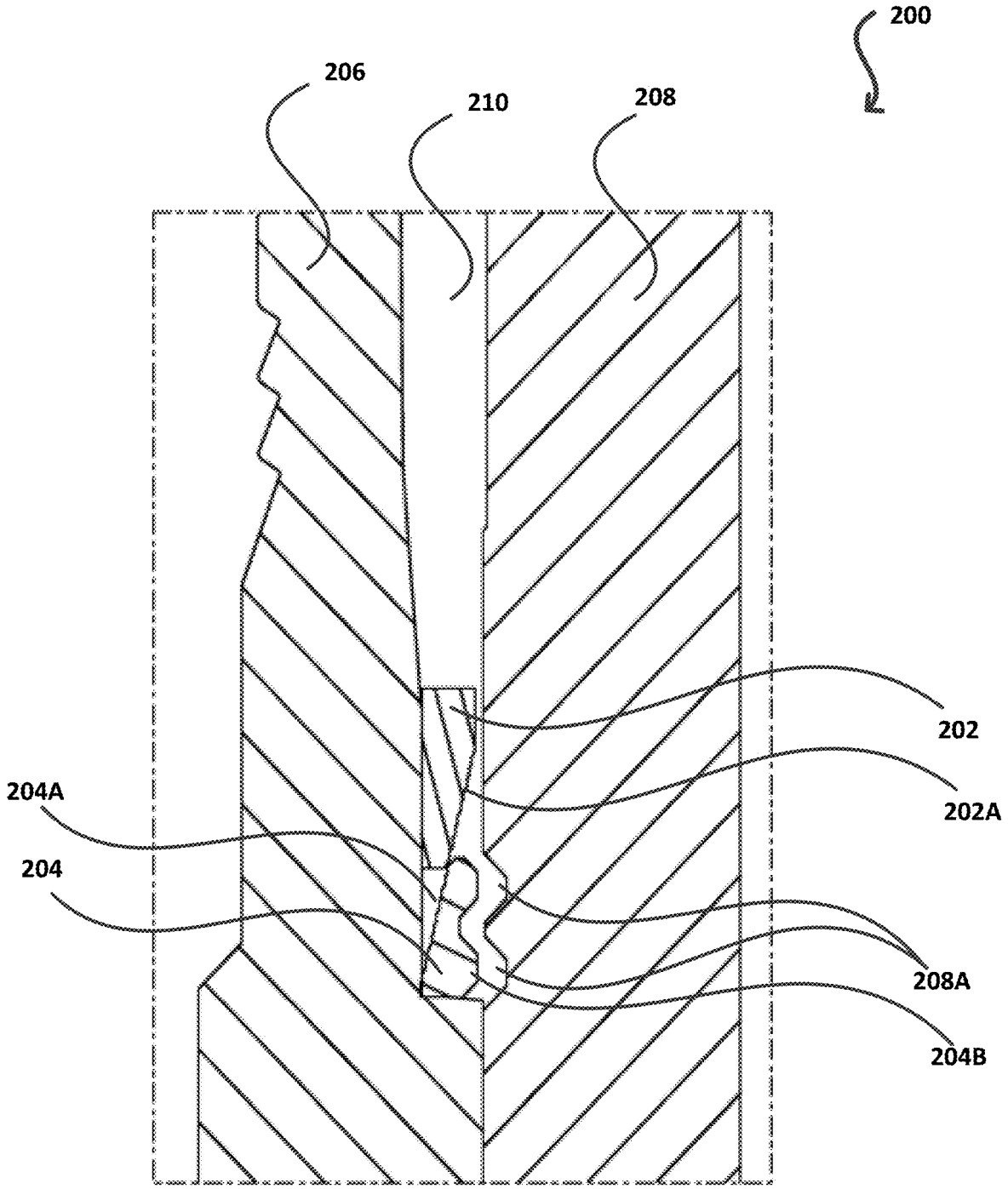
FIG. 2A illustrates an example system of a mechanical connector having stepped tapers in an application of a hanger-to-wellhead housing assembly, in accordance with an aspect of this disclosure.

FIG. 2A illustrates an example system 200 of a mechanical connector 204, in this case a lockdown ring, having stepped tapers 204A. Area 210 between hanger 206 and wellhead housing 208 (or any intermediate components, such as a slick bore) require a supporting structure where components are rigidly locked together. In an example, such a supporting structure with rigid locking between the hanger 206 and the wellhead housing 208 may be accomplished by a mechanical connector 204 for mechanical locking applications. A first surface of the mechanical connector 204 includes stepped tapers 204A for a mechanically loaded connection to a mating surface, illustrated as corresponding stepped tapers 202A of mating surface of actuating member 202. Further, a second surface having one or more engagement portions 204B is provided, illustrated here as protrusions from the surface opposing the stepped tapers 204A. The one or more engagement portions 204B support the mechanically loaded connection by engaging in one or more indentations 208A in the wellhead housing 208.

Figure 2B:
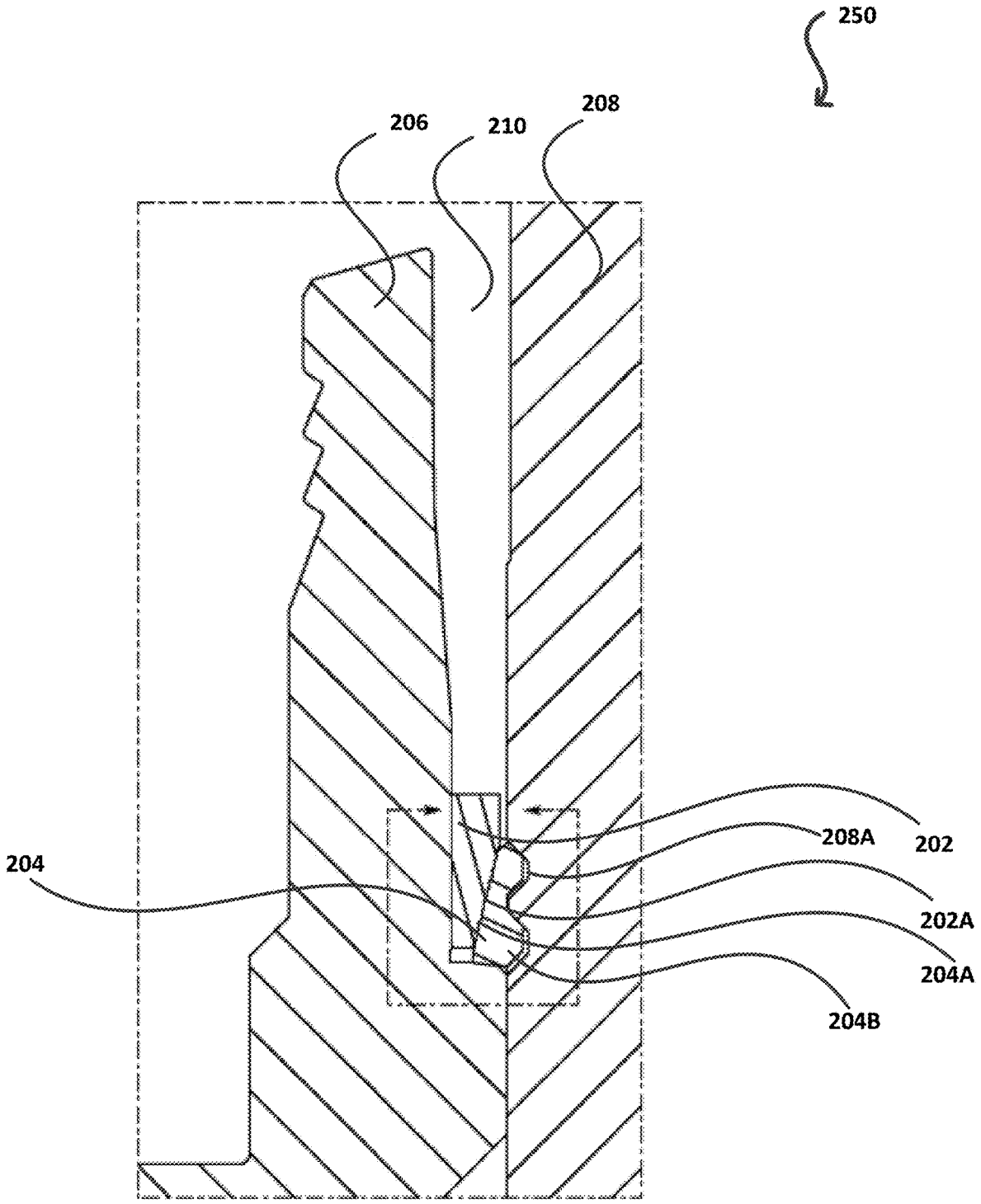
FIG. 2B illustrates a further example system of the mechanical connector of FIG. 2A in engagement, using its surfaces having stepped tapers, with associated mating surfaces having corresponding stepped tapers, in accordance with an aspect of this disclosure.

FIG. 2B illustrates a further example system 250 of the mechanical connector 204 of FIG. 2A in engagement, using its surfaces having stepped tapers, with associated mating surfaces having corresponding stepped tapers, in accordance with an aspect of this disclosure. In an example, FIG. 2A illustrates a landing stage or phase where components 204 and 202 are landed within area 210. FIG. 2B illustrates a locked phase where a rigid connection is made so that the components 204, 202 are able to support substantial load at a position that may be predetermined for the example system 250. FIG. 2B illustrates that the stepped tapers are fully engaged with the corresponding stepped tapers so that substantially all parts of the stepped tapers 204A of the mechanical connector 204 engage the corresponding parts of the stepped tapers 202A of the actuating member 202. In such a configuration, the mechanical connector 204 is rigidly locked in position relative to the actuating member 202 and against the rigid members 206, 208. The system 250 then behaves like it has an optimally-sized straight-interface actuating member and mechanical connector. The actuating member is fully self-locked and cannot back out during operation due to applied forces on the system 250. The combination of flats and steps in the stepped tapers causes the mechanical connector and the actuating member to ratchet as the actuating member urges the mechanical connector to engage.

Figure 2C:
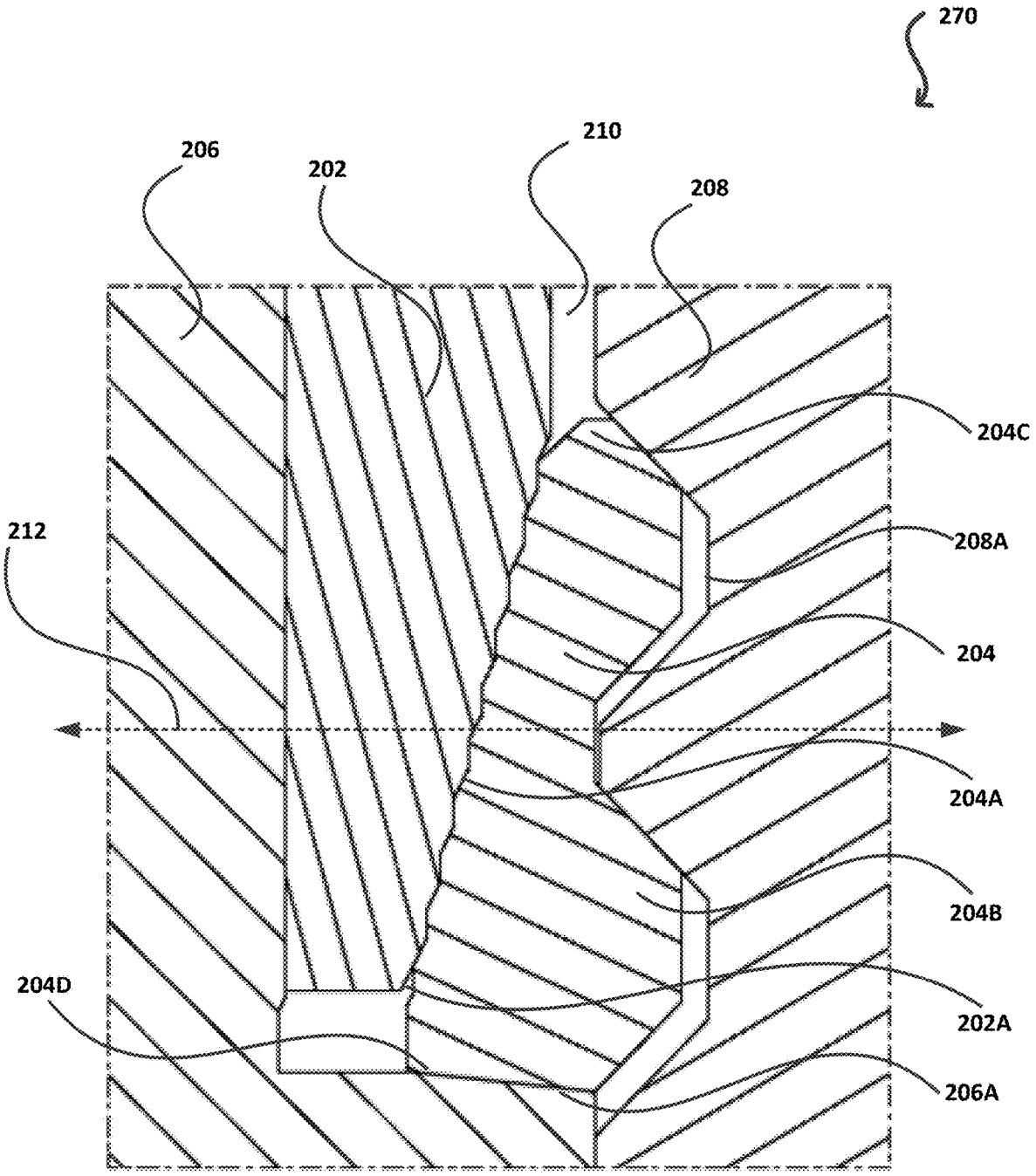
FIG. 2C illustrates an in-depth view of the mechanical connector of FIG. 2B in engagement, using its surfaces having stepped tapers, with associated mating surfaces having corresponding stepped tapers, in accordance with an aspect of this disclosure.

FIG. 2C illustrates an in-depth view 270 of the mechanical connector 204 of FIG. 2B in engagement (e.g., locked stage or phase), using its surfaces having stepped tapers 204A, with associated mating surfaces having corresponding stepped tapers 202A, in accordance with an aspect of this disclosure. Further, FIG. 2C illustrates that the mechanical connector 204 includes a bottom surface 204D for resting the mechanical connector on a lower member or on a surface 206A provided in the hanger 206. In the example system 200, 250, 270, the first surface is part of a lockdown ring and the mating surface is part of an actuator ring. The lockdown ring and the actuating ring are positioned between the wellhead housing and the hanger to support an annular seal (not shown). The mechanically loaded connection formed between the mechanical connector 204, the actuating member 202, and the rigid members 206, 208 extends laterally, illustrated by reference axis 212, from the first surface of the mechanical connector 204 (and also an interface formed by the first surface and a surface of the actuating member 202). A person of ordinary skill reading the present disclosure would recognize that the lateral direction of reference axis 212 of the mechanically loaded connection is not necessarily perpendicular to the interface of the mechanical connector 204 and the actuating member 202, but is perpendicular to an axis of the hanger and wellhead housing and/or parallel to mating surface 204D. As such, lateral is a reference to sideways loading caused by wedging the mechanical connector 204 with the actuating member 202 between the hanger and the wellhead housing.

In application, the mechanical connector 204 can be placed in area 210 between the rigid members 206, 208. The mechanical connector 204 may be first loosely engaged with the actuating member 202 before being placed in the area 210. Alternatively, the actuating member 202 may be separately placed in the area 210, subsequent to the placement of the mechanical connector 204. The actuating member 202 is illustrated in FIGS. 2A-2C as having corresponding stepped tapers 202A. The actuating member 202 may be influenced to slide against the stepped tapers in a ratcheting action. The actuating member 202 includes an opposing mating surface for tagging or engaging the hanger 206 or any rigid member otherwise provided in the area 210. In an example, a load may be applied to the actuating member 202 at its upper rigid portion so that each of the corresponding stepped tapers 202A ratchets against each of the stepped tapers 204A of the mechanical connector 204. As this happens, one or more protrusions 204B of a second surface of the mechanical connector 204 engage deeper into one or more indentations 208A of the rigid member 208. This process locks the mechanical connector 204 between the rigid members 206, 208 by virtue of the stepped tapers 204A being aligned substantially fully with the corresponding stepped tapers 202A. As such, the actuating member 202 locks with the mechanical connector 204 against the rigid members 206, 208 by a mechanically loaded connection extending laterally from an interface of the stepped tapers and the corresponding stepped tapers. The ratcheting action of ratcheting surfaces (i.e., the stepped tapers and the corresponding stepped tapers) prevents return movement of the mechanical connector or the mating surface of the actuating member 202.

Figure 3A:
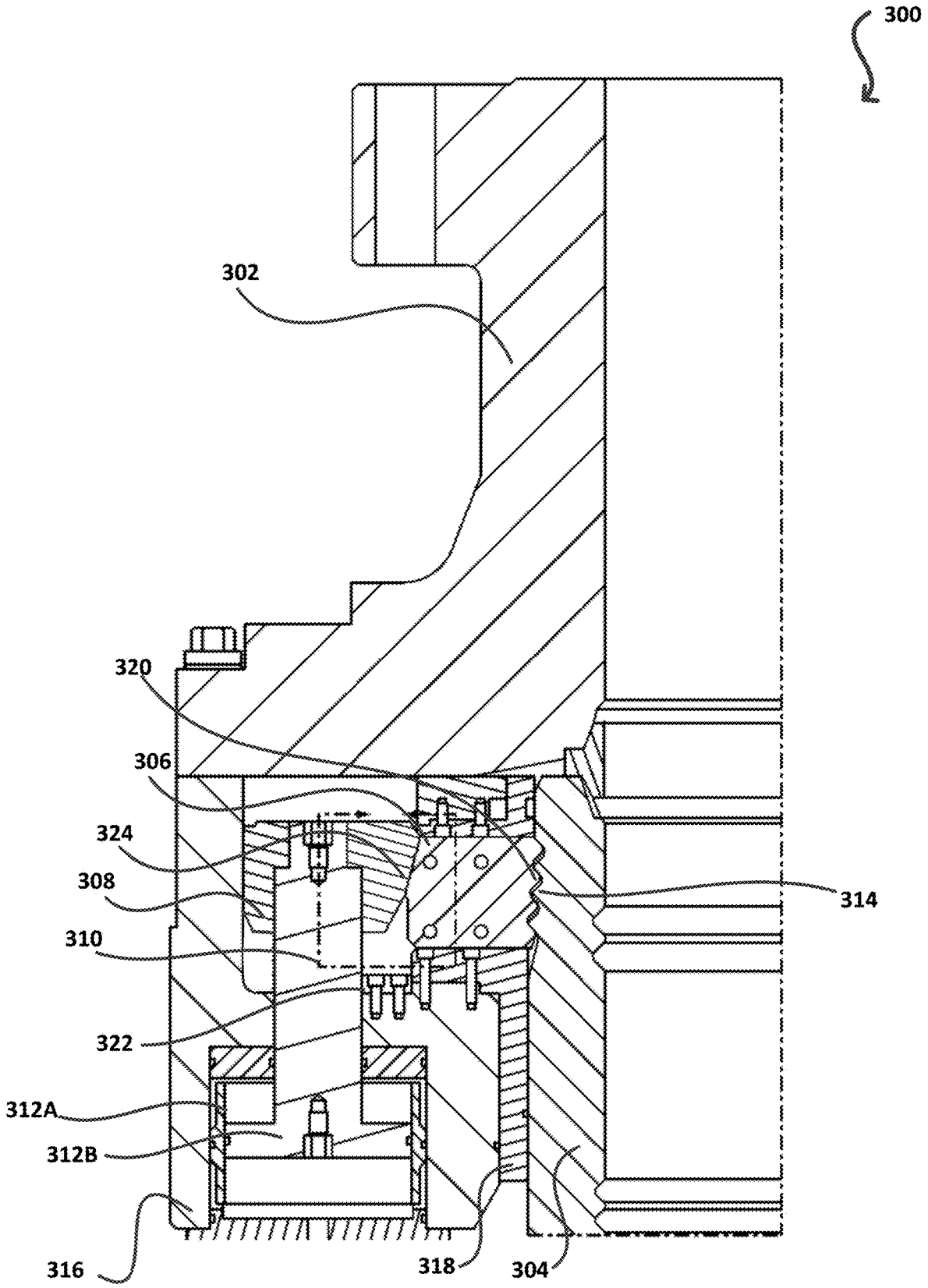
FIG. 3A illustrates an example system of a mechanical connector having stepped tapers in application of a wellhead connector, in accordance with an aspect of this disclosure.

FIG. 3A illustrates an example system 300 of a mechanical connector 308 having stepped tapers that correspond to tapers on a wellhead connector 302, in accordance with an aspect of this disclosure. In the example, the wellhead system 300 includes an adapter 302 to be connected with mandrel 304, with intermediate components omitted to focus on the rigid locking or supporting structure features of the present disclosure. The mandrel 304 may be a wellhead housing, a Christmas tree arrangement, or a blow-out preventer. Further, this and other aspects may be combined or modified in any way as described in the present disclosure and that is readily understood by a person of ordinary skill in the art. The person of ordinary skill reading the present disclosure would also recognize the components omitted, and would recognize modifications required to apply the present rigid locking and supporting structure features.

Figure 3B:
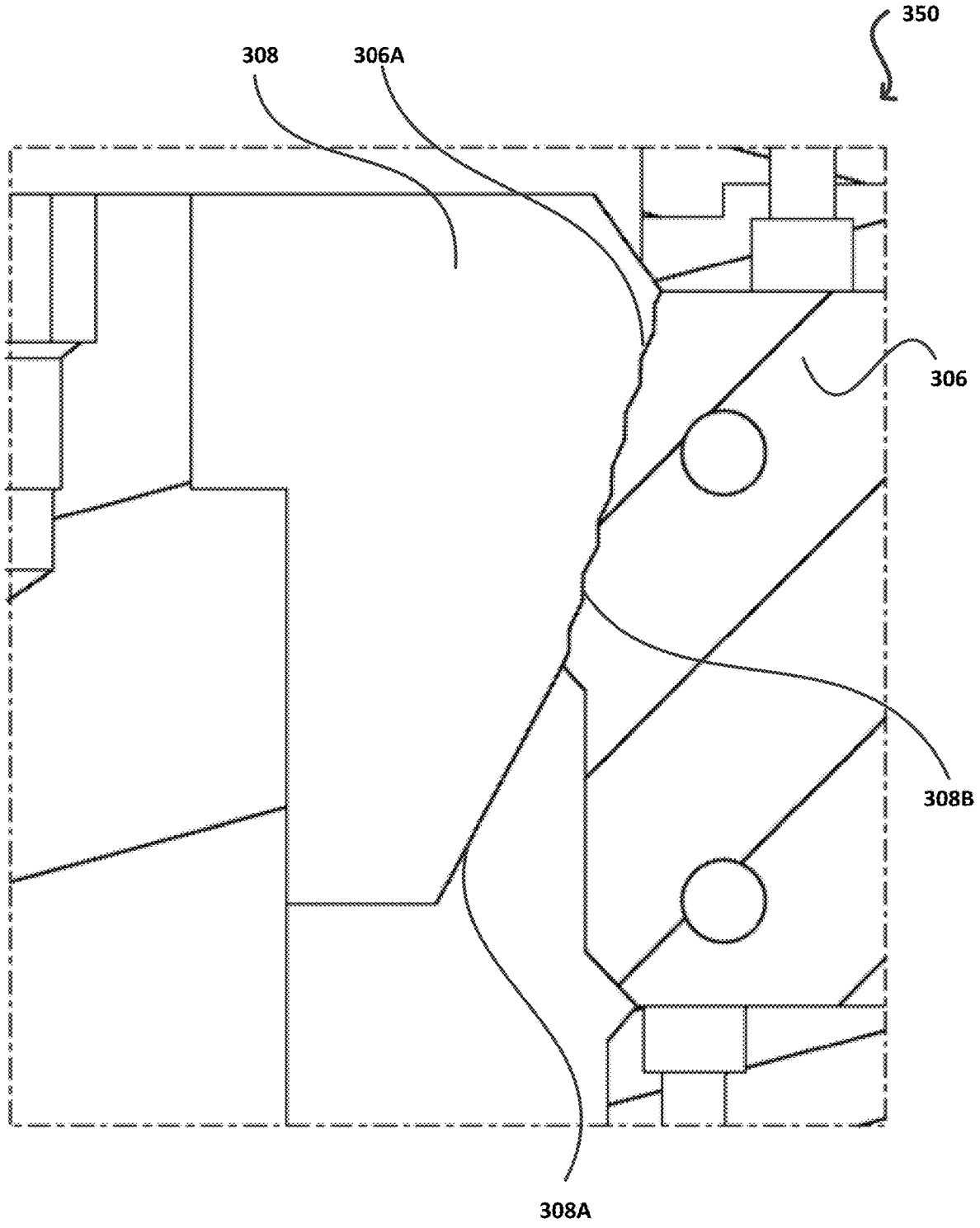
FIG. 3B illustrates an in-depth view of the mechanical connector of FIG. 3A in engagement with associated mating surfaces, in accordance with an aspect of this disclosure.

When the wellhead connector 302 is lowered on a riser string over a previously installed mandrel 304, an inner diameter of a lower insert 318 fits over an outer diameter of the mandrel 304 at a point of engagement, as illustrated. After wellhead connector 302 lands on the rim of the mandrel 304, hydraulic fluid pressures piston cylinder 312A to stroke piston 312B. Cam ring 308 in turn pushes dogs 306 radially into engagement with mandrel grooves 314. A large downward preload force is applied to the rim of the mandrel 304 as a result of teeth 320 of dogs 306 engaging grooves 314. A stop plate 322 limits the downward travel of cam ring 308 to prevent applying too much preload to an upper rim portion of the mandrel 304. Cam ring 308 has an inner diameter 324 that engages outer surfaces of the dogs 306. The present disclosure enables rigid locking of the cam ring 308 with the dogs 306, thereby forming a locking member. FIG. 3B illustrates an in-depth view 350 of the rigid locking 310 of a mechanical connector, such as the cam ring 308 of FIG. 3A, in engagement with associated mating surfaces, such as of one or more dogs 306, in accordance with an aspect of this disclosure. As such, a first surface 308A of the mechanical connector of example system 300, 350 is part of a cam ring 308 and the mating surface 306A is part of a locking member 306. The cam ring 308 and the locking member 306 are located in an area between the mandrel 304 and an outer wall 316 of the wellhead connector 302. The stepped tapers 308B of the mating surface 308A may be a portion of the mating surface 308A.

Figure 4:
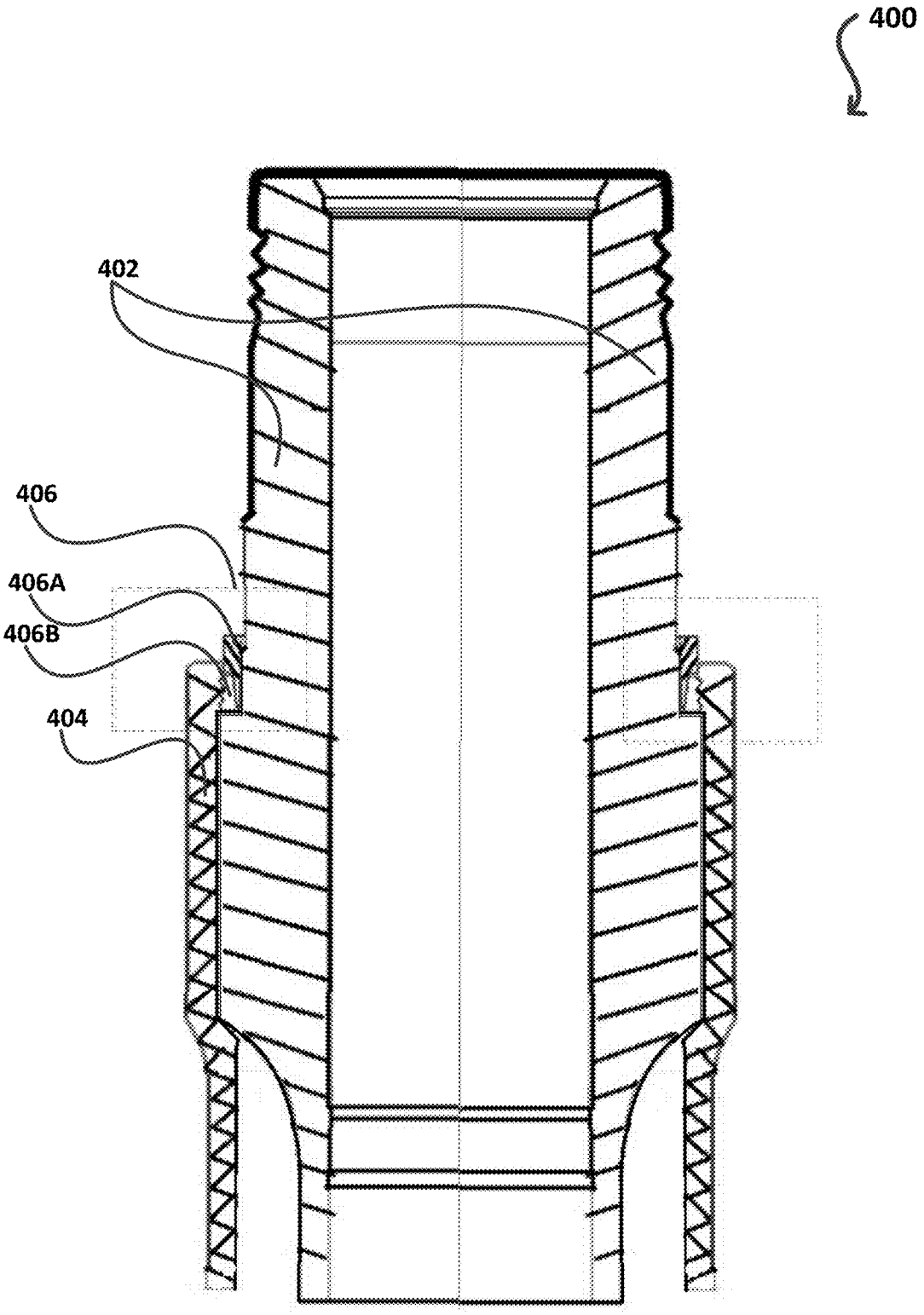
FIG. 4 illustrates an example system of a mechanical connector having stepped tapers in another application of a wellhead connector, in accordance with an aspect of this disclosure.

As previously noted, the mechanical connector and/or an associated actuating member may be applied in any mechanical application requiring rigid locking and or a supporting structure; and the above examples of a hanger lockdown and wellhead connector are only provided as non-limiting examples. FIG. 4 illustrates an example 400 of a mechanical connector 406B having stepped tapers in another application of a wellhead connector having a cam interface, in accordance with an aspect of this disclosure. In example 400, an actuating member 406A with associated stepped tapers is provided in section 406. The actuating member 406A is rigidly locked with the lockdown ring 406B, between a high pressure wellhead housing 402 and a low pressure wellhead housing 404. The mechanical connector 406B is provided with a first surface having stepped tapers and a second surface having one or more engagement portions, in a similar manner as in FIGS. 2B, 2C. The stage or phase illustrated in FIG. 4 is a locked phase for the mechanical connector 406B and the actuating member 406A between rigid members 404, 402. Furthermore, the mechanical connector 406B includes a bottom surface for supporting the mechanical connector 406B in a stable manner, on a shoulder of the rigid member 404 as illustrated, during the locking phase. When locked, example 400 represents a rigid locking achieved between high and low pressure cam interfaces for wellhead connectors. In a similar manner, mechanical connectors with stepped tapers and associated actuating members with corresponding stepped tapers may be used for tieback connectors, in riser joint connectors, pipeline connectors, and in flowline connectors (for trees, for pipeline end manifolds (PLEMs), and for pipeline end terminations (PLETs), etc.)

Figure 5:
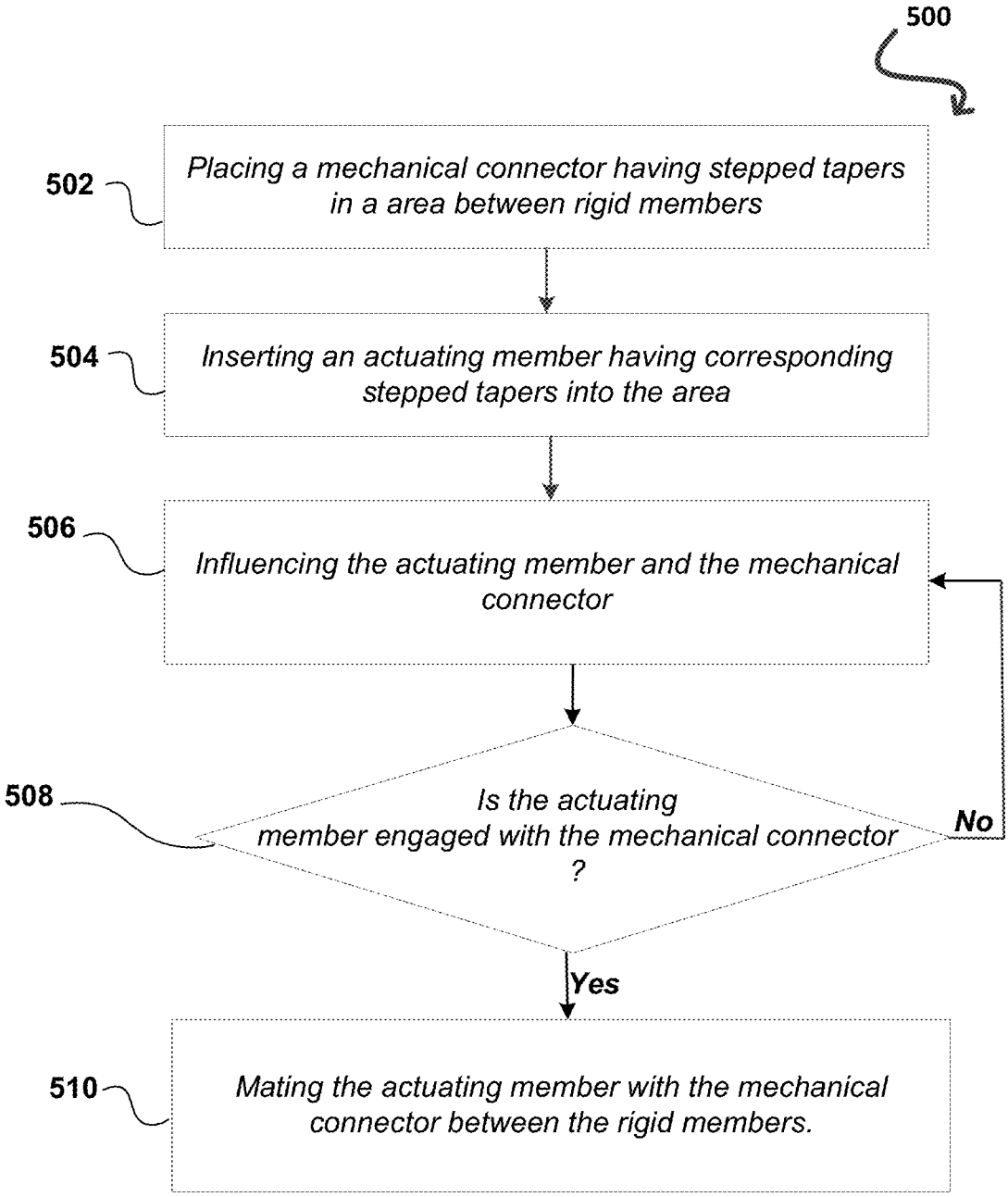
FIG. 5 illustrates a process flow for a method of using a mechanical connector including stepped tapers, in accordance with aspects of this disclosure.

FIG. 5 illustrates a process flow 500 for a method of using a mechanical connector including stepped tapers, in accordance with aspects of this disclosure. In sub-process 502 of process 500, a mechanical connector having stepped tapers is placed in an area between rigid members. As noted in the above embodiments, which may be combined or modified by a person of ordinary skill reading the present disclosure in any applicable manner, the mechanical connector may be engaged loosely with an actuating member and/or other intermediate or overlying components. As such, the placement of the mechanical connector in sub-process 502 does not preclude placement of the actuating member and/or other intermediate or overlying components concurrently or subsequently. In sub-process 504, the actuating member having corresponding stepped tapers is inserted into the area. As noted with respect to the sub-process 502, the placing of the mechanical connector may be concurrent with the actuating member, but as the actuating member is above or below, relatively, to the mechanical connector, the sub-process 504 may be applied as automatically following from sub-process 502.

An influencing of the actuating member is performed via sub-process 506 so that the actuating member begins to engage the stepped tapers. As in the system examples, the corresponding stepped tapers of the actuating member begin to mate against the stepped tapers of the mechanical connector to cause a ratcheting action. Sub-process 508 can first ensure that the actuating member and the mechanical connector are engaged so that the actuating member can be further influenced to mate and lock with the mechanical connector by virtue of the corresponding stepped tapers of the actuator ring being locked flat-to-flat against the stepped tapers of the mechanical connector. The process 500, in an aspect, enables control for a force of installation that influences the engagement and subsequent mating of the actuating member and the mechanical connector; and enables control of a preload of the mechanically loaded connection. In an example, the force may be predetermined as a theoretical value and then a force, in application, may be compared to the theoretical value to ensure that the mechanically loaded connection is achieved. In a configuration where the mechanically loaded connection is achieved, the supporting structure in the mechanically loaded connection is both locked and preloaded. As such, sub-process 508 may also include verification to more than an engagement, for e.g., that the actuating member is locked and preloaded with the mechanical connector.

A determination is made, in sub-process 510, that the actuating member is engaged with the mechanical connector between the rigid members, and a further force may be applied to mate the surfaces and cause a mechanically loaded connection extending laterally with respect to an interface of the stepped tapers and the corresponding stepped tapers. The mechanically loaded connection extending laterally may be also taken as in a direction perpendicular to an axis of the area or radially about the axis. For example, the mechanically loaded connection may be also taken as in a direction that is radially outwards and downwards, as partly illustrated in FIG. 2C, because of an embodiment where the mechanical connector may pivot to engage its protrusions with the indentations of the housing. The axis of the area is longitudinal, along a vertical bore axis in most applications, versus a latitudinal or side-to-side axis along which the mechanically loaded connection is achieved.

The specification and drawings are, accordingly, to be regarded in an illustrative rather than a restrictive sense. It will, however, be evident that various modifications and changes may be made thereunto without departing from the broader spirit and scope of the invention as set forth in the claims. Further, any of the many embodiments disclosed here may be combined by a person of ordinary skill using the present disclosure to understand the effects of such combinations.

What is claimed is:

1. A system for a wellhead assembly, comprising:

a first wellhead component defining at least one recess in an outer surface thereof;

a second wellhead component which is a single-piece component and which is positioned adjacent the first wellhead component;

a first annular member positioned adjacent the first wellhead component and having at least one protrusion configured to correspond to the at least one recess of the first wellhead component, the first annular member having a first tapered surface comprising thereon a plurality of first annular stepped tapers;

a second annular member positioned adjacent the first wellhead component and having a second tapered surface comprising thereon a plurality of second annular stepped tapers adapted to be fully engaged with the plurality of the first annular stepped tapers, in a locked phase for the first annular member and the second annular member, to limit relative upward movement between the first annular member and the second annular member; and a shoulder surface of the second wellhead component to support loading of the first annular member thereon in the locked phase.

2. The system of claim 1, wherein the first wellhead component is a wellhead housing, the second wellhead component is a hanger, the first annular member is a lockdown ring, and the second annular member is an actuating member.

3. The system of claim 1, wherein the first wellhead component is a mandrel, the second wellhead component is a wellhead connector, the first annular member is a lockdown ring, and the second annular member is a cam ring.

4. The system of claim 1, wherein the first wellhead component is a low pressure wellhead housing, the second wellhead component is a high pressure wellhead housing, the first annular member is a lockdown ring, and the second annular member is an actuating member.

5. The system of claim 1, wherein the first annular member stepped surface is configured to create a rigid interface between the first annular member and the second annular member.

6. The system of claim 1, wherein the first annular member is compressible so that the at least one protrusion enters the at least one recess of the first wellhead component as the first annular member engages the second annular member.

7. A system for a wellhead assembly, comprising:

a lockdown ring having a first lockdown ring tapered surface with a plurality of lockdown ring stepped tapers and having a bottom surface to load against a shoulder surface of a hanger of the wellhead assembly in a locked phase of the lockdown ring and an actuating member, wherein the hanger is a single-piece component, wherein the actuating member comprises a first actuating member tapered surface that has defined thereon a plurality of actuating member stepped tapers that correspond to the lockdown ring stepped tapers, and wherein the plurality of lockdown ring stepped tapers and the plurality of actuating member stepped tapers configured to be fully engaged with each other when positioned between a wellhead housing and the hanger in the locked phase to prevent relative upward movement between the lockdown ring and the actuating member.

8. The system of claim 7, wherein the lockdown ring has a second lockdown ring surface having at least one protrusion for engaging the wellhead housing.

9. The system of claim 8, wherein the wellhead housing defines at least one recess configured to receive the at least one protrusion of the second lockdown ring surface.

10. The system of claim 7, wherein the lockdown ring has a third lockdown ring surface positioned to engage a surface of the hanger.

11. The system of claim 7, wherein the interface between the plurality of lockdown ring stepped tapers and the plurality of actuating member stepped tapers is a ratcheting interface.

12. The system of claim 11, wherein the plurality of lockdown ring stepped tapers and the plurality of actuating member stepped tapers comprise predetermined shapes to prevent the relative movement between the lockdown ring and the actuating member.

13. The system of claim 7, wherein the actuating member has a second actuating member surface configured to engage the hanger.

14. A method for a wellhead assembly, comprising:

placing a mechanical connector, having a first mechanical connector tapered surface comprising thereon a plurality of mechanical connector stepped tapers, in an area between rigid members of the wellhead assembly;

inserting, into the area, an actuating member having a first actuating member tapered surface comprising thereon a plurality of actuating member stepped tapers; and enabling a bottom surface of the mechanical connector to load against a shoulder surface associated with one of the rigid members of the wellhead assembly in a locked phase of the mechanical connector and the actuating member, wherein the one of the rigid members is a single-piece component, and wherein the plurality of mechanical connector stepped tapers fully engage with the plurality of actuating member stepped tapers in the locked phase to prevent relative upward movement between the mechanical connector and the actuating member.

15. The method according to claim 14, further comprising:

inserting, concurrently, the mechanical connector and the actuating member in a loose engagement within the area.

16. The method according to claim 14, further comprising:

adjusting the relative position of the first mechanical connector tapered surface and the first actuating member tapered surface so that the plurality of mechanical connector stepped tapers ratchet against the plurality of actuating member stepped tapers until a predetermined position or a predetermined value for a mechanically loaded connection is achieved.

17. The method according to claim 16, wherein the step of adjusting the relative position of the first mechanical connector tapered surface and the first actuating member tapered surface further comprises causing one or more of:

a) a lateral extension of the mechanical connector towards a portion of the wellhead assembly, b) a rotation of the mechanical connector towards a portion of the wellhead assembly, c) a pivoting of the mechanical connector towards a portion of the wellhead assembly, and d) a tilting of the mechanical connector towards a portion of the wellhead assembly.

18. The method according to claim 14, further comprising:

inserting an annular seal in the area above the mechanical connector and the actuating member.

19. The method according to claim 14, further comprising:

providing a second mechanical connector surface configured to engage the wellhead assembly with the mechanical connector in a stable position in the area between the rigid members of the wellhead assembly.

20. The method according to claim 14, further comprising:

loading, directly or indirectly, the actuating member to enable mating of the plurality of actuating member stepped tapers with the plurality of mechanical connector stepped tapers.

* * * * *